US007008761B2

(12) United States Patent
Hasberg

(10) Patent No.: US 7,008,761 B2
(45) **Date of Patent: *Mar. 7, 2006**

(54) PROCESS FOR THE PREPARATION OF HIGH BROMIDE CUBICAL GRAIN EMULSIONS

(75) Inventor: Dirk J. Hasberg, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/815,072

(22) Filed: Mar. 31, 2004

(65) Prior Publication Data

US 2005/0221240 A1 Oct. 6, 2005

(51) Int. Cl.

| | |
|---|---|
| ***G03C 5/18*** | (2006.01) |
| ***G03C 5/26*** | (2006.01) |
| ***G03C 1/005*** | (2006.01) |
| ***G03C 1/494*** | (2006.01) |

(52) U.S. Cl. ..... 430/449; 430/567; 430/569

(58) Field of Classification Search ..... 430/567, 430/569, 449

See application file for complete search history.

(56) References Cited

U.S. PATENT DOCUMENTS

| | | | | |
|---|---|---|---|---|
| 3,650,757 | A | 3/1972 | Irie et al. | |
| 3,672,900 | A | 6/1972 | Kurz | |
| 4,067,739 | A | 1/1978 | Lewis | |
| 4,242,445 | A | 12/1980 | Saito | |
| 4,301,241 | A | 11/1981 | Saito | |
| 4,539,290 | A | 9/1985 | Mumaw | |
| 4,666,669 | A | 5/1987 | Mumaw | |
| 4,914,014 | A * | 4/1990 | Daubendiek et al. | 430/569 |
| 5,089,379 | A | 2/1992 | Yatsuyanagi | |
| 5,104,785 | A | 4/1992 | Ichikawa et al. | |
| 5,372,927 | A | 12/1994 | Delton | |
| 5,549,879 | A | 8/1996 | Chow | |
| 5,807,666 | A | 9/1998 | Adin et al. | |
| 5,840,473 | A | 11/1998 | Mydlarz et al. | |
| 5,849,470 | A | 12/1998 | Mydlarz et al. | |
| 5,908,740 | A | 6/1999 | Maskasky et al. | |
| 5,985,535 | A | 11/1999 | Urabe | |
| 6,043,019 | A | 3/2000 | Jagannathan et al. | |
| 6,048,683 | A | 4/2000 | Mehta et al. | |
| 6,136,523 | A | 10/2000 | Jezequel et al. | |
| 6,265,145 | B1 * | 7/2001 | Mehta et al. | 430/569 |
| 6,623,918 | B1 | 9/2003 | Hasberg et al. | |
| 6,753,134 | B1 * | 6/2004 | Hasberg et al. | 430/569 |
| 2004/0018456 | A1 | 1/2004 | Hasberg et al | |

FOREIGN PATENT DOCUMENTS

| | | |
|---|---|---|
| DE | 2107118 | 2/1970 |

OTHER PUBLICATIONS

"Growth Mechanism Of AgBr Crystals In Gelatin Solution"; of J. S. Wey et al; Photographic Science And Engineering; vol. 21; No. 1; Jan./Feb. 1977; pp. 14-18.

Research Disclosure; vol. 382; Feb. 1996; Item 38213; titled "Mixer For Improved Control Over Reaction Environment"; pp. 111-114; Disclosed Anonymously.

* cited by examiner

*Primary Examiner*—Geraldine Letscher
(74) *Attorney, Agent, or Firm*—Andrew J. Anderson

(57) ABSTRACT

A process for the preparation of a radiation-sensitive silver halide emulsion comprised of high bromide cubical silver halide grains, the process comprising: (a) providing in a stirred reaction vessel a dispersing medium and high bromide silver halide grain cores, the grain cores comprising at least 5 mole % of the final emulsion silver and the contents of the vessel being maintained at a temperature of at least about 65° C., and (b) precipitating a high bromide silver halide shell which comprises at least 5 mole % of the final emulsion silver onto the grain cores by introducing at least a silver salt solution into the dispersing medium at a specified high rate, wherein a minor percentage of chloride ions, relative to bromide, is introduced into the reaction vessel prior to or concurrent with precipitation of the high bromide shell, and wherein the concentration of silver halide grains in the reaction vessel at the end of the precipitation of the shell is at least 0.5 mole/L. The invention provides an improved manufacturing process for the preparation of high bromide silver halide cubical grain emulsion enabling concentrated emulsion batches to be prepared with desired photographic properties.

19 Claims, 3 Drawing Sheets

PROCESS FOR THE PREPARATION OF HIGH BROMIDE CUBICAL GRAIN EMULSIONS

FIELD OF THE INVENTION

This invention is directed to the preparation of radiation sensitive high bromide silver halide photographic emulsions. It particularly relates to the preparation of the exterior portions of silver halide emulsion grains after formation of a core.

DEFINITION OF TERMS

In referring to grains and emulsions containing two or more halides, the halides are named in order of ascending concentrations.

The term "high bromide" and "high chloride" in referring to silver halide grains and emulsions indicate greater than 50 mole percent bromide or chloride, respectively, based on total silver.

The term "equivalent spherical diameter" or "ESD" indicates the diameter of a sphere having a volume equal to the volume of a grain or particle.

The term "size" in referring to grains and particles, unless otherwise described, indicates ESD.

The term "regular grain" refers to a silver halide grain that is internally free of stacking faults, which include twin planes and screw dislocations.

The term "cubic grain" is employed to indicate a regular grain is that bounded by six {100} crystal faces. Typically the corners and edges of the grains show some rounding due to ripening, but no identifiable crystal faces other than the six {100} crystal faces. The six {100} crystal faces form three pairs of parallel {100} crystal faces that are equidistantly spaced.

The term "cubical grain" is employed to indicate grains that are at least in part bounded by {100} crystal faces satisfying the relative orientation and spacing of cubic grains. That is, three pairs of parallel {100} crystal faces are equidistantly spaced. Cubical grains include both cubic grains and grains that have one or more additional identifiable crystal faces. For example, tetradecahedral grains having six {100} and eight {111} crystal faces are a common form of cubical grains.

The term "central portion" or "core" in referring to silver halide grains refers to an interior portion of the grain structure that is first precipitated relative to a later precipitated portion.

The term "shell" in referring to silver halide grains refers to an exterior portion of the silver halide grain which is precipitated on a central portion.

The term "dopant" is employed to indicate any material within the rock salt face centered cubic crystal lattice structure of a silver halide grain other than silver ion or halide ion.

The term "dopant band" is employed to indicate the portion of the grain formed during the time that dopant was introduced to the grain during precipitation process.

The term "normalized shell molar addition rate", hereinafter assigned the symbol $R_s$, is a measure of the intensity of rate of addition of silver salt solution to a reaction vessel during formation of a shell. $R_s$ is defined by the formula:

$$R_s = \frac{M_s}{M_t t_s^2}$$

where $M_s$ is the number of moles of silver halides added to the reaction vessel during the formation of the shell, $t_s$ is the run time, in minutes, of the silver salt solution for the formation of the shell, and $M_t$ is total moles of silver halides in the reaction vessel at the end of the precipitation.

The term "surface area normalized instantaneous molar addition rate", hereinafter assigned the symbol $R_i$, is a measure of the intensity of the rate of addition of silver salt solution to a reaction vessel during formation of a silver halide shell on silver halide grain cores, relative to the total surface area of grain cores already formed in the vessel. $R_i$ is defined by the formula:

$$R_i = \frac{Q_f C_f}{nS_c}$$

where $Q_f$ is the volumetric rate of addition, in liters/min, of silver salt solution to the reaction vessel, $C_f$ is the concentration, in moles/liter, of the silver salt solution, $S_c$ is the average surface area of an individual grain core already formed in the vessel, and n is the total number of grains in the vessel. $nS_c$ is thus the total surface area of silver halide grain cores in the reaction vessel at the precise moment of addition of the silver salt solution.

*Research Disclosure* is published by Kenneth Mason Publications, Ltd., Dudley House, 12 North St., Emsworth, Hampshire P010 7DQ, England.

BACKGROUND OF THE INVENTION

Double-jet precipitation is a common practice in the making of silver halide emulsions. Silver salt solution and halide salt solution are introduced simultaneously, but separately, into a precipitation reactor under mixing. In order to achieve desired crystal characteristics, typically, the silver ion activity or the halide ion activity is controlled during the precipitation by adjusting the feed rates of the salt solutions using either a silver ion sensor or a halide ion sensor.

Formation of silver halide emulsions typically involves a crystal nuclei-forming step wherein addition of silver ion results primarily in the precipitation of new crystal nuclei, and a subsequent double-jet growth step wherein the rate at which silver and halide are introduced is controlled to primarily grow the crystals already previously formed while avoiding the formation of new seed grains, i.e., renucleation. Addition rate control to avoid renucleation, and thereby generally provide for a more monodisperse grain size final grain population, is generally well known in the art, as illustrated by Wilgus German OLS No. 2,107,118; Irie U.S. Pat. No. 3,650,757; Kurz U.S. Pat. No. 3,672,900; Saito U.S. Pat. No. 4,242,445; Teitschied et al European Patent Application 80102242; "Growth Mechanism of AgBr Crystals in Gelatin Solution", Photographic Science and Engineering, Vol. 21, No. 1, January/February 1977, p. 14, et seq. The term "critical crystal growth rate" is used in the art to describe the growth rate obtained at the maximum rate of silver ion and halide ion addition which does not produce renucleation. While maintaining silver and halide addition rates below that which form new grain populations is advantageous during grain growth in terms of controlling the emulsion grain population characteristics, it also can restrict obtainable emulsion concentrations (i.e., batch yields) and lengthen emulsion manufacturing times.

U.S. Pat. Nos. 5,549,879; 6,043,019; 6,048,683 and 6,265,145 disclose double jet techniques for preparing silver halide grains wherein silver and halide salt solutions are added at a "pulsed flow" rate designed to generate a second grain population (i.e., at a rate above that which would provide for the critical crystal growth rate), with multiple short "pulses" being separated by hold periods designed to allow the new grain population to be ripened out. U.S. Pat. No. 5,549,879, e.g., discloses introducing an aqueous silver nitrate solution from a remote source by a conduit which terminates close to an adjacent inlet zone of a mixing device, which is disclosed in greater detail in *Research Disclosure*, Vol. 382, February 1996, Item 38213. Simultaneously with the introduction of the aqueous silver nitrate solution and in an opposing direction, aqueous halide solution is introduced from a remote source by a conduit which terminates close to an adjacent inlet zone of the mixing device. The mixing device is vertically disposed in a reaction vessel and attached to the end of a shaft, driven at high speed by any suitable means. The lower end of the rotating mixing device is spaced up from the bottom of the vessel, but beneath the surface of the aqueous silver halide emulsion contained within the vessel. Baffles, sufficient in number to inhibit horizontal rotation of the contents of the vessel are located around the mixing device. The described apparatus is operated in a "pulse flow" manner comprising the steps of: (a) providing an aqueous solution containing silver halide particles having a first grain size; (b) continuously mixing the aqueous solution containing silver halide particles; (c) simultaneously introducing a soluble silver salt solution and a soluble halide salt solution into a reaction vessel of high velocity turbulent flow confined within the aqueous solution for a time t, wherein high is at least 1000 rpm; (d) simultaneously halting the introduction of the soluble silver salt solution and the soluble halide salt solution into the reaction for a time T wherein T>t, thereby allowing the silver halide particles to grow; and (e) repeating steps (c) and (d) until the silver halide particles attain a second grain size greater than the first grain size. Advantages of the pulse flow technique described include permitting easier scalability of the precipitation method. There is no disclosure of use of such pulse flow technique to enable larger emulsion concentrations (i.e., batch yields) or shorten emulsion manufacturing times. To the contrary, the disclosed need for relatively long hold times between pulsed addition of silver and halide salts can result in longer manufacturing times.

U.S. Pat. No. 6,043,019 teaches the use of pulsed flow growth for high bromide tabular grain emulsion after a speed-enhancing amount of iodide is added to the reaction vessel. Such emulsions are more robust for chemical sensitization, have an improved speed-granularity relationship and they exhibit reduced intrinsic fog. Thus, pulsed growth appears to affect iodide incorporation in tabular grains in a beneficial way. There is no disclosure of use of such pulse flow technique to enable preparation of high bromide emulsion grains having desired performance characteristics while increasing emulsion concentrations (i.e., batch yields) or shorten emulsion manufacturing times. To the contrary, the pulsed addition of silver halide salts is described specifically for only the outer 5 to 50 percent (and more preferably for only the outer 5 to 30 percent) of silver forming the final tabular grain emulsion, and the pulses are separated by hold times. Further, there is no disclosure of use of the described process to prepare high bromide cubical emulsion grains.

U.S. Pat. No. 6,048,683 teaches a pulse flow process for the preparation of high chloride cubical silver halide grains grown in the presence of a thioether ripening agent wherein the resulting silver chloride grains exhibit an average grain roundness coefficient, n, in the range of from 2 to less than 15. U.S. Pat. No. 6,265,145 teaches a process for the preparation of high chloride cubical silver halide grains containing from 0.05 to 3 mole percent iodide where iodide is incorporated in the grains by introducing at least a silver salt solution into the dispersing medium at a rate such that the normalizing molar addition rate $R_n$ is above $5\times10^{-2}$ $min^{-1}$ where $R_n$ satisfies the formula $$R_n = \frac{Q_f C_f}{M}$$

where $Q_f$ is the volumetric rate of addition, in liters/min, of silver salt solution to the reaction vessel, $C_f$ is the concentration, in moles/liter, of the silver salt solution, and M is the total moles of silver halide in the host grains in the reaction vessel at the precise moment of addition of the silver salt solution. There is no disclosure, however, of use of the above processes to prepare high bromide silver halide cubical grain emulsions.

U.S. 2004/0018456 discloses that normalized shell molar addition rates substantially higher than critical crystal growth rates typically determined in accordance with prior art techniques may be employed for preparation of monodisperse high bromide cubic emulsions. While reagent addition rates only slightly greater than that which would be associated with such conventionally determined critical crystal growth rates are believed to simultaneously result in both renucleation and growth of the pre-existing grain cores as well as the renucleated seeds, and thus a decrease in grain size uniformity (i.e., increase in polydispersity), it is disclosed that where the normalized shell molar addition rate is further increased to higher levels (i.e., where $R_s$, is above $1.0\times10^{-3}$ $min^{2}$, $R_s$ satisfying the formula:

$$R_s = \frac{M_s}{M_t t_s^2}$$

where $M_s$ is the number of moles of silver halides added to the reaction vessel during the formation of the shell, $t_s$ is the run time, in minutes, of the silver salt solution for the formation of the shell, and $M_t$ is total moles of silver halide in the reaction vessel at the end of the precipitation of the shell), substantially all of the added reagent is precipitated into fine grains which then ripen primarily only onto the larger pre-existing host grain cores, resulting in a relatively monodisperse emulsion.

While substantially all of the added reagent is precipitated into fine grains which then ripen primarily only onto the larger pre-existing host grain cores in accordance with the process described in U.S. 2004/0018456, it has been found that depending upon other process conditions, there still may exist maximum addition rates above which the fine grains formed via high normalized shell molar addition rates become stable and result in the formation of a minor, though still generally undesirable, fraction of a secondary grain population. The stabilization of these fine grains is a result of the inability of the system to effectively ripen all of the precipitated fine grains onto the grain cores of the primary grain population during shell growth. It would be desirable to provide a process that extends the conditions under which high bromide cubical grain emulsions of a desired grain size may be obtained under high normalized shell molar addition rates while minimizing the occurrence of secondary grain populations.

SUMMARY OF THE INVENTION

In one aspect, this invention is directed to a process for the preparation of a radiation-sensitive silver halide emulsion comprised of high bromide cubical silver halide grains, the process comprising:

(a) providing in a stirred reaction vessel a dispersing medium and high bromide silver halide grain cores, the grain cores comprising at least 5 mole % of the final emulsion silver and the contents of the vessel being maintained at a temperature of at least about 65° C., and (b) precipitating a high bromide silver halide shell which comprises at least 5 mole % of the final emulsion silver onto the grain cores by introducing at least a silver salt solution into the dispersing medium at a rate such that (i) the normalized shell molar addition rate, $R_s$, is above $1.0\times10^{-3}$ $min^{-2}$, $R_s$ satisfying the formula:

$$R_s = \frac{M_s}{M_t t_s^2}$$

where $M_s$ is the number of moles of silver halides added to the reaction vessel during the formation of the shell, $t_s$ is the run time, in minutes, of the silver salt solution for the formation of the shell, and $M_t$ is total moles of silver halide in the reaction vessel at the end of the precipitation of the shell, and (ii) when the contents of the reaction vessel are maintained at a temperature of from 65° C. to 70° C., the surface area normalized instantaneous molar addition rate, $R_i$, is above (24T-1380) mol/min/$m^2$ during at least a portion of the shell growth, where T represents the temperature of the contents of the vessel in ° C., and when the contents of the vessel are maintained at a temperature above 70° C., $R_i$ is above 300 mol/min/$m^2$, $R_i$ satisfying the formula:

$$R_i = \frac{Q_f C_f}{n S_c}$$

where $Q_f$ is the volumetric rate of addition, in liters/min, of silver salt solution to the reaction vessel, $C_f$ is the concentration, in moles/liter, of the silver salt solution, $S_c$ is the average surface area of an individual grain core already formed in the vessel, and n is the total number of grain cores in the vessel;

wherein a minor percentage of chloride ions, relative to bromide, is introduced into the reaction vessel prior to or concurrent with precipitation of the high bromide shell, and wherein the concentration of silver halide grains in the reaction vessel at the end of the precipitation of the shell is at least 0.5 mole/L.

The invention provides an improved manufacturing process for the preparation of high bromide silver halide cubical grain emulsion enabling concentrated emulsion batches to be prepared with desired photographic properties.

DESCRIPTION OF PREFERRED EMBODIMENTS

Figure 1:
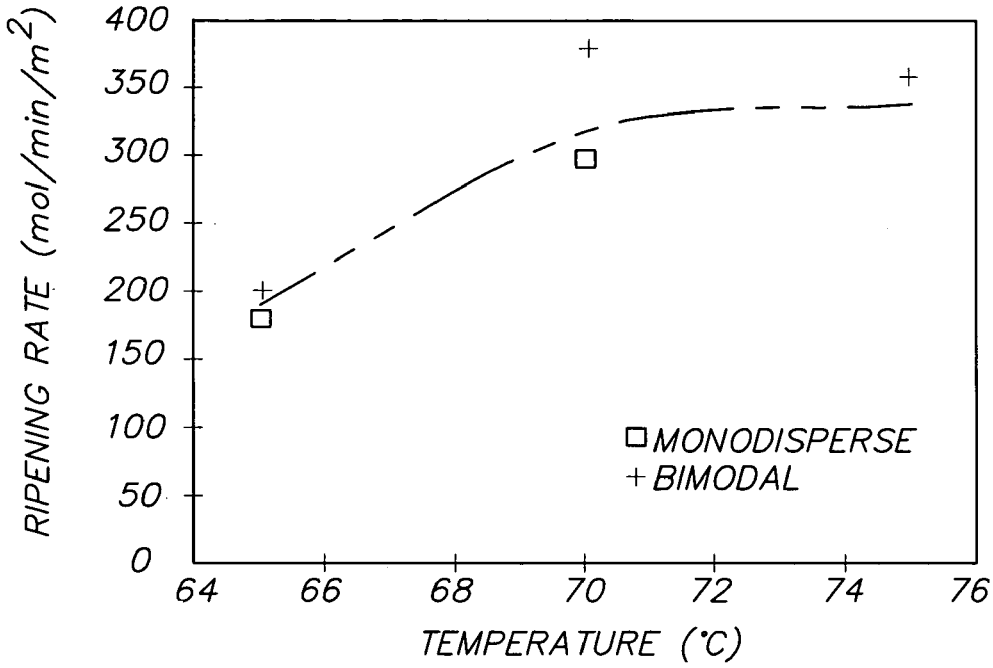
FIG. 1 is a graph of critical ripening rate as a function of temperature for silver bromide emulsions.

High bromide cubical silver halide grains precipitated in accordance with the invention contain greater than 50 mole percent bromide, based on silver. Preferably the grains contain at least 70 mole percent bromide and, optimally at least 90 mole percent bromide, based on silver. The method of the invention can be employed to prepare high bromide cubical grain emulsions of any conventional mean grain size known to be useful in photographic elements. Mean grain sizes in the range of from 0.15 to 2.5 $\mu$m are typical, with larger mean grain sizes within such range generally being preferred to provide increased sensitivity, and smaller mean grain sizes within such range generally being preferred to provide improved granularity results in photographic elements employing such emulsions. The present process has been found to advantageously uniquely enable preparation of relatively monodisperse (COV less than 20%, preferably less than 15%, more preferably less than 10%) high bromide cubical grain emulsions with mean grain sizes of at least 0.5 $\mu$M, more preferably at least 0.7 $\mu$m.

The method of the invention can be viewed as a modification of conventional methods for preparing high bromide cubical grain emulsions, wherein after formation of a host core grain emulsion grain population a substantial portion of total silver of the emulsion (i.e., at least 5 mole percent, preferably at least 20 mole percent, more preferably at least 30 mole percent, more preferably greater than 50 mole percent, even more preferably at least 60 mole percent, and most preferably at least 70 mole percent) is added to the reaction vessel in the form of a silver salt solution at a relatively high normalized shell molar addition rate. Any convenient conventional silver halide seed or host grain precipitation procedure may be employed to form the host grain core population, which in accordance with the invention accounts for at least 5 mole percent, preferably from about 10 to less than 50 mole percent, and more preferably from 10 to about 30 mole percent, of total silver of the final emulsion to be formed. The host grain emulsion cores can have any halide concentrations consistent with the general halide requirement for high bromide grains.

While levels of iodide and/or chloride consistent with the overall composition requirements of the grains can be included within the host grains, in one specifically contemplated preferred form the host seed grain emulsion is an essentially pure silver bromide cubical grain emulsion. The host grains are preferably cubic, but can include other cubical forms, such as tetradecahedral forms. Techniques for forming emulsions satisfying the host grain requirements of the preparation process are well known in the art. The rate at which silver nitrate and sodium bromide (or other silver and halide sources) are added into the reactor during precipitation of the host grains can be at any practical molar addition rate. The initially formed host grains then serve as cores for further grain growth.

Once a host grain population has been prepared which will account for at least 5 mole percent (preferably at least 10 percent) of total silver of the final emulsion, silver salt solution is added at a high normalized shell molar addition rate (i.e., $R_s$ greater than $1.0\times10^{-3}$ min $^{-2}$, preferably greater than or equal to $2.0\times10^{-3}$ min$^{-2}$) in accordance with the invention to create an outer shell comprising at least 5 mole percent (preferably at least 20 percent, and more preferably greater than 50 mole percent) of total silver of the final emulsion. Where the reaction vessel contains excess halide ions, the silver salt solution may be added by itself to precipitate the outer shell. It is preferred, however, to simultaneously introduce a halide salt solution into the dispersing medium with the silver salt solution. Bromide salt may be added as the halide salt, either alone or in combination with chloride or iodide salts consistent with the overall composition requirements of the grains to be formed. The concentration of silver halide grains in the reaction vessel at the end of the precipitation of the shell is at least 0.5 mole/L, preferably at least 0.8 mole/L and more preferably at least 1.0 mole/L.

Further in accordance with the invention, when the contents of the reaction vessel are maintained at a temperature of from 65° C. to 70° C., the surface area normalized instantaneous molar addition rate, $R_i$, is above (24T-1380) mol/min/m$^2$ during at least a portion of the shell growth, where T represents the temperature of the contents of the vessel in ° C., and when the contents of the vessel are maintained at a temperature above 70° C., $R_i$ is above 300 mol/min/m$^2$ $R_i$ satisfying the formula:

$$R_i = \frac{Q_f C_f}{nS_c}$$

where $Q_f$ is the volumetric rate of addition, in liters/min, of silver salt solution to the reaction vessel, $C_f$ is the concentration, in moles/liter, of the silver salt solution, $S_c$ is the average surface area of an individual grain core already formed in the vessel, and n is the total number of grain cores in the vessel. In accordance with specific embodiments of the invention, $R_i$ is above 300 mol/min/m$^2$, and more preferably above 350 mol/min/m$^2$, during at least a portion of the shell growth when the contents of the reaction vessel are maintained at a temperature of at least 65° C.

The number of grains (n) in a monodisperse emulsion may conveniently be determined by measuring the average grain volume and use of the following formula:

$$n=[m(mw_{Ag}+mw_{Br})]/\rho V_G$$

where ρ=density of AgBr cubic grains (6473 kg/m$^3$), $mw_{Ag}$=molecular weight of Ag (107.9), $mw_{Br}$=molecular weight of Br (79.9), m=total moles of Ag in the emulsion, and $V_G$=Single grain average volume.

The single grain average volume may be determined according to the formula:

$$V_G=\pi d^3/6$$

where d is the equivalent Stokes diameter (esd, which is the diameter of a sphere with equivalent volume) of the emulsion grains determined employing disc centrifuge techniques.

The cubic edge length, a, of a cube having an esd of d is:

$$a = d\left(\frac{\pi}{6}\right)^{\frac{1}{3}}$$

The single grain surface area, $S_G$, of a cube with esd of d is thus:

$$S_G = 6d^2\left(\frac{\pi}{6}\right)^{\frac{2}{3}}$$

The single grain core surface area, $S_c$, of a cube with esd of d and core fraction of total Ag, f, is then determined according to the formula:

$$S_C = 6d^2\left(\frac{f\pi}{6}\right)^{\frac{2}{3}}$$

The rate at which fine grains effectively ripen during emulsion grain growth is dependant on the system characteristics such as temperature, residence time, and solution viscosity, but most importantly to the above described surface area normalized instantaneous molar addition rate $R_i$. The minimum $R_i$ values set forth above define a region wherein it has been found that, absent countervailing measures, silver bromide fine grains will not completely effectively ripen during shell growth in a high normalized shell molar addition rate process. The experimentally determined critical ripening rate as a function of temperature for silver bromide emulsions is represented in FIG. 1, which indicates whether a second stable grain population is obtained for various silver bromide emulsions prepared under high normalized shell molar addition rate processes at various temperatures (details of the experimental emulsion make processes are provided in the below Examples). While an essentially monomodal distribution of grain size is obtained for silver bromide emulsions prepared at a temperature of 65° C. and an $R_i$ rate of 180 mol/min/m$^2$, as well as for silver bromide emulsions prepared at a temperature of 70° C. and an $R_i$ rate of 300 mol/min/m$^2$, bimodal distributions of grain sizes are obtained for otherwise essentially equivalent emulsions prepared at higher $R_i$ rates at such temperatures. At a temperature of 75° C., a bimodal distribution is obtained at a similar $R_i$ rate as found to result in a bimodal distribution at 70° C. FIG. 1 thus illustrates that, absent countervailing measures, at $R_i$ rates above (24T-1380) mol/min/m$^2$ for temperatures T of from 65° C. to 70° C., and above 300 mol/min/m$^2$ for temperatures above 70° C., the fine silver bromide grains formed in a high normalized shell molar addition rate process may be stable, and the resulting high bromide silver halide emulsion may have a bimodal particle size distribution. Since 75° C. is generally considered to be a practical upper limit for temperature in the precipitation of silver halide emulsions, FIG. 1 illustrates that, absent countervailing measures, $R_i$ rates above approximately 350 mol/min/m$^2$ appear likely to result in high bromide silver halide emulsions which will have a bimodal particle size distribution at all temperatures from 65–75° C.

Further in accordance with the invention, a minor percentage of chloride ions, relative to bromide, is introduced into the reaction vessel prior to or concurrent with precipitation of the high bromide shell. The presence of a minor percentage of chloride ions, even at concentrations as low as 0.001 M, in the reaction vessel during high bromide shell growth in accordance with the invention allows for $R_i$ surface area normalized instantaneous molar addition rates higher than the above described minimums to be practiced, while still avoiding the formation of a secondary stable grain population which may otherwise occur in the absence of any chloride ion at such high $R_i$ rates. The chloride ion is believed to act as a ripening agent, which facilitates ripening of the fine grains formed via the high normalized shell molar addition rates employed in the process. Accordingly, the chloride ion need not be actually incorporated into the high bromide grain shells themselves at detectable levels.

Chloride ions may, however, be added at concentrations sufficient to effect precipitation along with bromide ions into the shells at detectable levels. Silver bromide and silver chloride are miscible in all proportions; hence, any portion of the total halide not accounted for bromide, can be chloride. While chloride ions may be incorporated in high bromide grain emulsions at high levels, in order to maintain sensitivity advantages associated with high bromide emulsion versus high chloride emulsions, chloride inclusions are preferably limited to up to 20 mole percent, based on silver. In accordance with a specific embodiments, the final grains may comprise, e.g., from 0.2 to 20 mole percent chloride, more preferably from 0.5 to 15 mole percent chloride, based on total silver. Incorporation of iodide into high bromide grains is limited by iodide solubility levels (e.g., approx. 40 mole % iodide in silver iodobromide grains). Iodide at levels of, e.g., 0.25 to 10 mole percent in high bromide emulsions is common, and is well know in the art to provide increases in speed and other effects.

At the conclusion of grain precipitation the grains can take varied cubical forms, ranging from cubic grains (bounded entirely by six {100} crystal faces), grains having an occasional identifiable {111} face in addition to six {100} crystal faces, and, at the opposite extreme tetradecahedral grains having six {100} and eight {111} crystal faces. Formation of cubic grains during grain growth, e.g., may be favored by controlling the relative silver and halide ion solution concentrations as well known in the art (e.g., maintaining pAg at 8.10 or less, preferably 7.80 or less and more preferably 7.60 or less).

It is surprising that the grains comprising shells formed using high rates of reagents addition as required in accordance with the invention not only contribute to a more productive manufacturing process, but are also compatible with achieving higher levels of photosensitivity. After examining the performance of emulsions exhibiting varied cubical grain shapes, it has been concluded that the performance of the improved cubicity emulsions obtained in accordance with preferred embodiments of the invention is principally determined by an improvement in the uniformity of grain size dispersity and cubicity enabled by the process of the invention, relative to emulsions prepared at conventional rates of reagent addition. The high bromide cubical silver halide grains prepared in accordance with the invention preferably exhibit a grain size coefficient of variation of less than 35 percent and optimally less than 25 percent. Much lower grain size coefficients of variation can be realized, but progressively smaller incremental advantages are realized as dispersity is minimized. The present process has been found to advantageously uniquely enable preparation of relatively monodisperse (COV less than 20%, preferably less than 15%, more preferably less than 10%) high bromide cubical grain emulsions with mean grain sizes of at least 0.5 $\mu$m, more preferably at least 0.7 $\mu$m.

The normalized shell molar addition rate in accordance with the invention is substantially higher than critical crystal growth rates typically determined in accordance with prior art techniques. While reagent addition rates only slightly greater than that which would be associated with such conventionally determined critical crystal growth rates are believed to simultaneously result in both renucleation and growth of the pre-existing seeds as well as the renucleated seeds, and thus a decrease in grain size uniformity (i.e., increase in polydispersity), it has been surprisingly found that where the normalized shell molar addition rate is further increased to levels in accordance with the invention, substantially all of the added reagent is precipitated into fine grains which then ripen primarily only onto the larger pre-existing seed or host grains, resulting a relatively monodisperse emulsion.

In the simplest form of silver halide grain preparation in accordance with the invention, nucleation and growth stages may occur in the same reaction vessel. Two or more separate reaction vessels can be substituted for the single reaction vessel, however. Nucleation and initial growth of seed grains can be performed in an upstream reaction vessel, e.g., and the dispersed grain nuclei can be transferred to a downstream reaction vessel in which the subsequent shell growth step occurs. Arrangements which separate grain nucleation from grain growth, e.g., are disclosed by Mignot U.S. Pat. No. 4,334,012 (which also discloses the useful feature of ultrafiltration during grain growth); Urabe U.S. Pat. No. 4,879,208 and published European Patent Applications 326,852; 326,853; 355,535 and 370,116, Ichizo published European Patent Application 0 368 275; Urabe et al published European Patent Application 0 374 954; and Onishi et al published Japanese Patent Application (Kokai) 172,817-A (1990).

It is specifically contemplated to incorporate dopants into the silver halide emulsion grains of the invention during precipitation. The use of dopants in silver halide grains to modify photographic performance is generally illustrated by *Research Disclosure*, Item 38957, cited above, I. Emulsion grains and their preparation, D. Grain modifying conditions and adjustments, paragraphs (3)–(5). Photographic performance attributes known to be affected by dopants include sensitivity, reciprocity failure, and contrast.

Once high bromide cubical grains have been precipitated as described above, chemical and spectral sensitization, followed by the addition of conventional addenda to adapt the emulsion for the imaging application of choice can take any convenient conventional form. These conventional features are illustrated by *Research Disclosure*, Item 38957, cited above, particularly:

III. Emulsion washing;
IV. Chemical sensitization;
V. Spectral sensitization and desensitization;
VII. Antifoggants and stabilizers;
VIII. Absorbing and scattering materials;
Ix. Coating and physical property modifying addenda; and
X. Dye image formers and modifiers.

Some additional silver halide, generally less than 5 percent and typically less than 1 percent, based on total silver, can be introduced to facilitate chemical sensitization. It is also recognized that silver halide can be epitaxially deposited at selected sites on a host grain to increase its sensitivity. For the purpose of providing a clear demarcation, the term "silver halide grain" is herein employed to include the silver necessary to form the grain up to the point that the final major {100} crystal faces of the grain are formed. Silver halide later deposited that does not overlie the major crystal faces previously formed accounting for at least 50 percent of the grain surface area is excluded in determining total silver forming the silver halide grains. Thus, silver forming selected site epitaxy is not part of the silver halide grains while silver halide that deposits and provides the final major crystal faces of the grains is included in the total silver forming the grains, even when it differs significantly in composition from the previously precipitated silver halide.

The emulsions of the invention may be chemically sensitized as known in the art. Preferred chemical sensitizers include gold and sulfur chemical sensitizers. Typical of suitable gold and sulfur sensitizers are those set forth in Section IV of *Research Disclosure* 38957, September 1996. Preferred is colloid aurous sulfide such as disclosed in *Research Disclosure* 37154 for good speed and low fog. It is also possible to add dopants during emulsion finishing.

The emulsions can be spectrally sensitized in any convenient conventional manner. Spectral sensitization and the selection of spectral sensitizing dyes is disclosed, for example, in *Research Disclosure*, Item 38957, cited above, Section V. Spectral sensitization and desensitization. The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines. Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

The silver bromide emulsions are preferably protected against changes in fog upon aging. Preferred antifoggants can be selected from among the following groups:

A. A mercapto heterocyclic nitrogen compound containing a mercapto group bonded to a carbon atom which is linked to an adjacent nitrogen atom in a heterocyclic ring system, B. A quaternary aromatic chalcogenazolium salt wherein the chalcogen is sulfur, selenium or tellurium, C. A triazole or tetrazole containing an ionizable hydrogen bonded to a nitrogen atom in a heterocyclic ring system, or D. A dichalcogenide compound comprising an —X—X— linkage between carbon atoms wherein each X is divalent sulfur, selenium or tellurium.

The above groups of antifoggants are known in the art, and are described in more detail, e.g., in U.S. Pat. No. 5,792,601, the disclosure of which is incorporated by reference herein.

In the simplest contemplated form a recording element in accordance with the invention can consist of a single emulsion layer satisfying the emulsion description provided above coated on a conventional radiographic support, such as those described in *Research Disclosure*, Item 38957, cited above, XVI. Supports. With a single emulsion layer unit a monochromatic image is obtained. It is, of course, recognized that the elements of the invention can include more than one emulsion. Where more than one emulsion is employed, such as in an element containing a blended emulsion layer or separate emulsion layer units, all of the emulsions can be high bromide silver halide emulsions prepared as contemplated by this invention. Alternatively one or more conventionally prepared emulsions can be employed in combination with the emulsions of this invention. For example, a separate emulsion, such as a silver chloride or bromochloride emulsion, can be blended with an emulsion prepared according to the invention to satisfy specific imaging requirements. For example, emulsions of differing speed are conventionally blended to attain specific aim radiographic characteristics. Instead of blending emulsions, the same effect can usually be obtained by coating the emulsions that might be blended in separate layers. It is well known in the art that increased radiographic speed can be realized when faster and slower emulsions are coated in separate layers with the faster emulsion layer positioned to receiving exposing radiation first. When the slower emulsion layer is coated to receive exposing radiation first, the result is a higher contrast image. Specific illustrations are provided by *Research Disclosure*, Item 36544, cited above Section I. Emulsion grains and their preparation, Subsection E. Blends, layers and performance categories.

The emulsion layers as well as optional additional layers, such as overcoats and interlayers, contain processing solution permeable vehicles and vehicle modifying addenda. Typically these layer or layers contain a hydrophilic colloid, such as gelatin or a gelatin derivative, modified by the addition of a hardener. Illustrations of these types of materials are contained in *Research Disclosure*, Item 36544, previously cited, Section II. Vehicles, vehicle extenders, vehicle-like addenda and vehicle related addenda. The overcoat and other layers of the photographic element can usefully include an ultraviolet absorber, as illustrated by *Research Disclosure*, Item 36544, Section VI. UV dyes/optical brighteners/luminescent dyes, paragraph (1). The overcoat, when present can usefully contain matting agents to reduce surface adhesion. Surfactants are commonly added to the coated layers to facilitate coating. Plasticizers and lubricants are commonly added to facilitate the physical handling properties of the photographic elements. Antistatic agents are commonly added to reduce electrostatic discharge. Illustrations of surfactants, plasticizers, lubricants and matting agents are contained in *Research Disclosure*, Item 36544, previously cited, Section IX. Coating physical property modifying addenda.

A specific preferred application of the invention is in the preparation of high bromide emulsions for use in medical diagnostic imaging radiographic elements, particularly elements that are sensitive to IR radiation. A number of varied photographic film constructions have been developed to satisfy the needs of medical diagnostic imaging. The common characteristics of these films is that they (1) produce viewable silver images having maximum densities of at least 3.0 and (2) are designed for rapid access processing. It is specifically contemplated, e.g., that the process of the invention will be useful in preparing highly cubic high bromide emulsions for use in radiographic photographic elements intended for rapid processing such as described in U.S. Pat. Nos. 5,089,379 and 5,981,161, the disclosures of which are incorporated by reference herein, in combination with the various specific useful iodide contents, sensitizing dyes, surface active agents, azaindene compound and dopants such as described therein.

The following examples illustrate the practice of this invention. They are not intended to be exhaustive of all possible variations of the invention. Parts and percentages are by weight unless otherwise specified.

EXAMPLES

Two silver bromide emulsions were prepared in which the variation made was in the silver addition rate for the shell portion of the silver halide grain.

Example 1

Two silver bromide emulsions were prepared in which the variation made was in the silver salt addition rate for the shell portion of the silver halide grain.

Emulsion 1.1 (Comparison)

To a reactor containing 4.5 kg of distilled water, 0.5 g of $(HOCH_2CH_2SCH_2)_2$ and 350 g of bone gelatin, were added 6.7 g of sodium bromide such that the mixture was maintained at a pBr of about 1.9 at approximately 65° C. Aqueous solutions of about 3.1 M silver nitrate and about 3.3 M sodium bromide were then added by conventional controlled double-jet addition at a constant silver nitrate flow rate of about 30 ml/min for about 2.0 minutes while maintaining pBr constant at about 1.9 and then the silver nitrate addition rate was accelerated over the next 6.0 minutes to 75 ml/min. The pBr was ramped with the accelerating silver salt flow to a value of 3.3. While maintaining a flowrate of 75 ml/min of silver nitrate solution, 0.1 g of $K_2IrCl_6$ where added in 0.75 minutes at a pBr of 3.3. The silver nitrate addition rate was then increased from 75 to 125 ml/min over 8.25 minutes while maintaining pBr at 3.3. This is considered to be the core of the silver halide grain containing 20.3% of the total silver moles.

The grain shell was then grown under a balanced double jet addition such that the silver nitrate addition rate was maintained over a 21 minute period at 245 ml/min at constant pBr of 3.3, for a total silver salt addition time of 38 minutes, with a normalized shell molar addition rate of $1.83\times10^{-3}$ min $^{-2}$. At the completion of the silver salt addition, the temperature was adjusted to 40° C. The silver bromide emulsion thus prepared had an ESD of 0.39 $\mu$m.

Emulsion 1.2 (Comparison)

An emulsion was grown with an identical core such as described in Emulsion 1.1. The grain shell was then grown under a balanced double jet addition such that the silver nitrate addition rate was maintained over a 24.5 minute period at 210 ml/min at constant pBr of 3.3, for a total silver salt addition time of 41.5 minutes, with a normalized shell molar addition rate of $1.33\times10^{-3}$ min$^{-2}$. At the completion of the silver salt addition, the temperature was adjusted to 40° C. The silver bromide emulsion thus prepared had an ESD of 0.40 $\mu$m.

Emulsions 1.1 and 1.2 were washed by the ultrafiltration method described in *Research Disclosure*, Vol. 131, March 1975, Item 13122, and analyzed for grain size distribution using disc centrifuge techniques. The average grain equivalent spherical diameter, ESD, and ESD width index obtained are indicated in Table 1:

TABLE 1

| Example | ESD | ESD Width Index | $R_i$ Rate [mol/min/m$^2$] |
|---|---|---|---|
| Emulsion 1.1 - Comparison | 0.39 | 1.067 | 200 |
| Emulsion 1.2 - Comparison | 0.40 | 1.056 | 180 |

Figure 2:
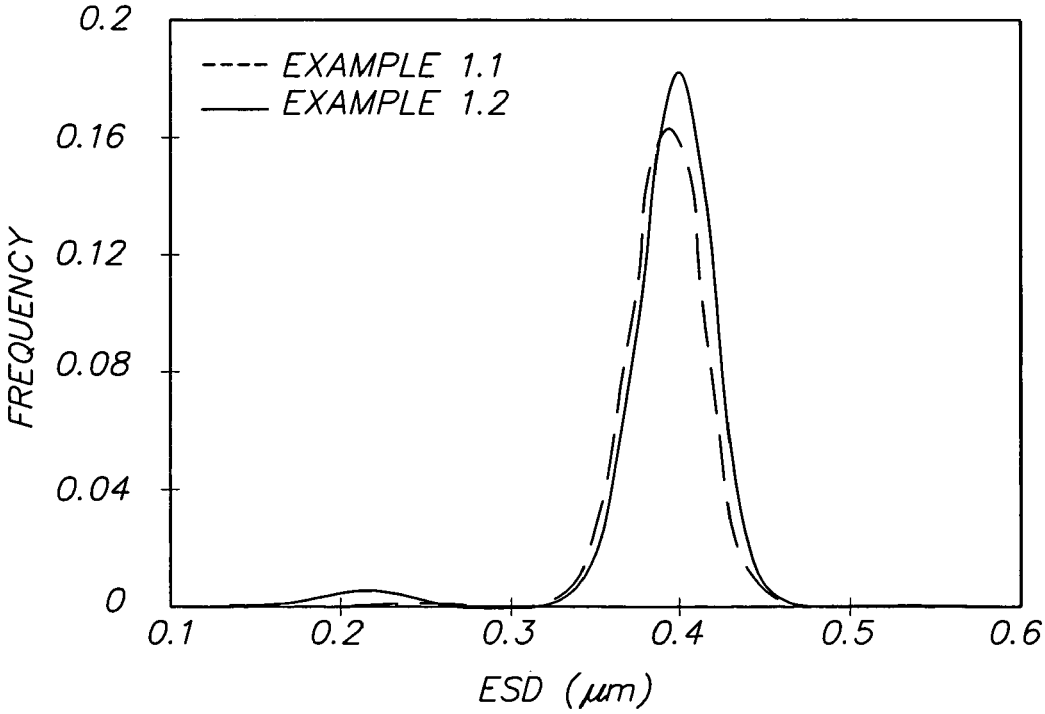
FIG. 2 is a graph of grain size populations of the two emulsions of Example 1.

FIG. 2 represents the grain size populations of the two emulsions of example 1 measured using disc centrifuge apparatus. The creation of a second population of grains formed during the shell growth of Emulsion 1.1 can be eliminated by reducing the surface area normalized instantaneous molar addition rate $R_i$ at the beginning of the shell growth by reduction in the silver nitrate molar addition rate, resulting in a reduction of the normalized shell molar addition rate ($1.33\times10^{-3}$ min$^{-2}$ vs. $1.83\times10^{-3}$ min$^{-2}$). Elimination of the secondary population by this method, however, results in an increase in precipitation time and a decrease in productivity.

Example 2

Two silver bromide emulsions were prepared in which the variation made was in the silver salt addition rate for the shell portion of the silver halide grain.

Emulsion 2.1 (Comparison)

To a reactor containing 4.3 kg of distilled water, 1.2 g of $(HOCH_2CH_2SCH_2)_2$ and 360 g of bone gelatin, were added 1.9 g of sodium bromide such that the mixture was maintained at a pBr of about 2.4 at approximately 70° C. Aqueous solutions of about 3.1 M silver nitrate and about 3.3 M sodium bromide were then added by conventional controlled double-jet addition at a constant silver nitrate flow rate of about 9 ml/min for about 3.0 minutes while maintaining pBr constant at about 2.4 and then the silver nitrate addition rate was accelerated over the next 24.5 minutes to 125 ml/min. The pBr was ramped with the accelerating silver salt flow to a value of 3.2. This is considered to be the core of the silver halide grain containing 22.1% of the total silver moles.

The grain shell was then grown under a balanced double jet addition such that the silver nitrate addition rate was maintained over a 20 minute period at 250 ml/min at constant pBr of 3.2, for a total silver salt addition time of 47.5 minutes, with a normalized shell molar addition rate of $1.95\times10^{-3}$ min$^{-2}$. At the completion of the silver salt addition, the temperature was adjusted to 40° C. The silver bromide emulsion thus prepared had an ESD of 0.78 $\mu$m.

Emulsion 2.2 (Comparison)

An emulsion was grown with an identical core such as described in Emulsion 2.1. The grain shell was then grown under a balanced double jet addition such that the silver nitrate addition rate was maintained over a 26.5 minute period at 190 ml/min at constant pBr of 3.2, for a total silver salt addition time of 41.5 minutes, with a normalized shell molar addition rate of $1.11\times10^{-3}$ min$^{-2}$. At the completion of the silver salt addition, the temperature was adjusted to 40° C. The silver bromide emulsion thus prepared had an ESD of 0.80 $\mu$m.

Emulsions 2.1 and 2.2 were washed by the ultrafiltration method described in *Research Disclosure*, Vol. 131, March 1975, Item 13122, and analyzed for grain size distribution using disc centrifuge techniques. The average grain equivalent spherical diameter, ESD, and ESD width index obtained are indicated in Table 2:

TABLE 2

| Example | ESD | ESD Width Index | $R_i$ Rate [mol/min/m$^2$] |
|---|---|---|---|
| Emulsion 2.1 - Comparison | 0.78 | 1.137 | 380 |
| Emulsion 2.2 - Comparison | 0.80 | 1.052 | 300 |

Figure 3:
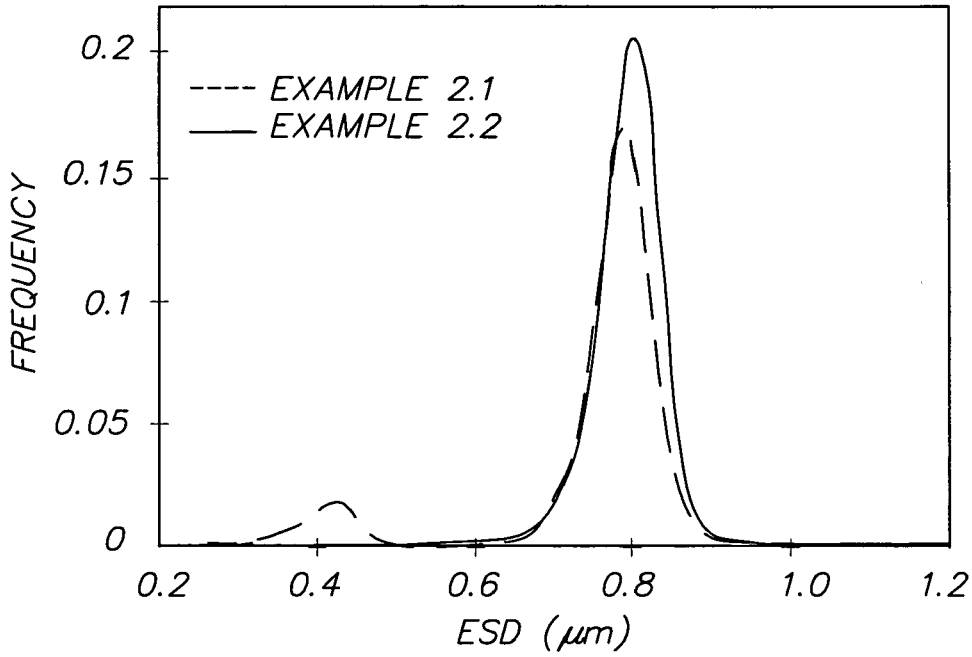
FIG. 3 is a graph of grain size populations of the two emulsions of Example 2.

FIG. 3 represents the grain size populations of the two emulsions of Example 2 measured using disc centrifuge apparatus. As in Example 1, the presence of a second population of grains formed during the shell growth of Emulsion 2.1 can be eliminated by reducing the surface area normalized instantaneous molar addition rate $R_i$ at the beginning of the shell growth by reduction in the silver nitrate molar addition rate, resulting in a reduction of the normalized shell molar addition rate ($1.11\times10^{-3}$ min −2 vs. $1.95\times10^{-3}$ $min^{-2}$). Elimination of the secondary population by this method results in an increase in precipitation time and a decrease in productivity.

In comparison to Example 1, the higher temperature used for the precipitation in Example 2, demonstrate that the ripening rate at which the formation of a secondary population of grains occurs is higher. For an increase in temperature from 65° C. to 70° C., the maximum $R_i$ rate for a single grain size population increases from approximately 180 to 300 mol/min/$m^2$ (as indicated in FIG. 1).

Example 3

Two silver bromide emulsions were prepared in which the variation made was the addition of NaCl between formation of the core and shell portions of the silver halide grain.

Emulsion 3.1 (Comparison)

To a reactor containing 4.5 kg of distilled water, 1.5 g of $(HOCH_2CH_2SCH_2)_2$ and 360 g of bone gelatin, were added 7.55 g of sodium bromide such that the mixture was maintained at a pBr of about 1.8 at approximately 70° C. Aqueous solutions of about 3.1 M silver nitrate and about 3.3 M sodium bromide were then added by conventional controlled double-jet addition at a constant silver nitrate flow rate of about 10 ml/min for about 3.0 minutes while maintaining pBr constant at about 1.9 and then the silver nitrate addition rate was accelerated over the next 14.5 minutes to 125 ml/min. The pBr was ramped with the accelerating silver salt flow to a value of 3.2. This is considered to be the core of the silver halide grain containing 11.6% of the total silver moles.

The grain shell was then grown under a balanced double jet addition such that the silver nitrate addition rate was maintained over a 27 minute period at 210 ml/min at constant pBr of 3.2, for a total silver salt addition time of 44.5 minutes, with a normalized shell molar addition rate of $1.21\times10^{-3}$ min $^{-2}$. At the completion of the silver salt addition, the temperature was adjusted to 40° C. The silver bromide emulsion thus prepared had an ESD of 0.91 $\mu$m.

Emulsion 3.2 (Invention)

An emulsion was grown with an identical core such as described in Emulsion 3.1. To this solution was added 2.0 g of NaCl. The grain shell was then grown as described in Emulsion 3.1. The silver bromide emulsion thus prepared had an ESD of 0.95 $\mu$m.

Emulsions 3.1 and 3.2 were washed by the ultrafiltration method described in *Research Disclosure*, Vol. 131, March 1975, Item 13122, and analyzed for grain size distribution using disc centrifuge techniques. The average grain equivalent spherical diameter, ESD, and ESD width index obtained are indicated in Table 3:

TABLE 3

| Example | ESD | ESD Width Index | $R_i$ Rate [mol/min/$m^2$] |
|---|---|---|---|
| Emulsion 3.1 - Comparison | 0.91 | 1.057 | 570 |
| Emulsion 3.2 - Invention | 0.95 | 1.051 | 600 |

Figure 4:
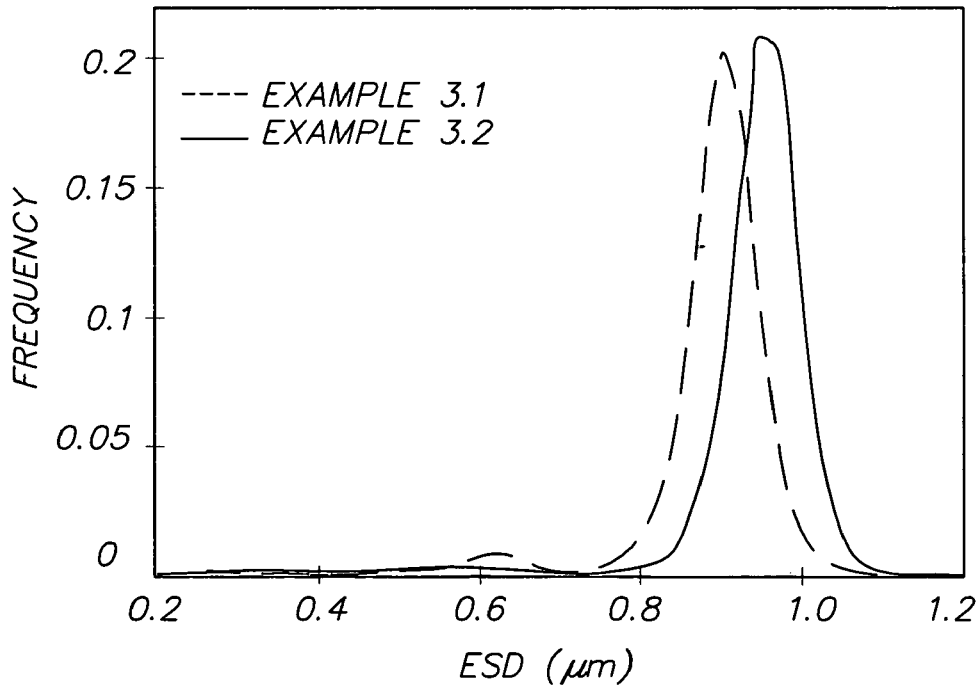
FIG. 4 is a graph of grain size populations of the two emulsions of Example 3.

FIG. 4 represents the grain size population measured using a disc centrifuge apparatus of the two emulsions of example 3. The emulsion shell for Emulsion 3.1 was grown at an elevated surface area normalized instantaneous molar addition rate $R_i$ which resulted in the formation of a secondary grain population. The relative frequency of this secondary population was advantageously significantly reduced by the inventive Emulsion 3.2. Elimination of the secondary population by this method did not result in an increase in the precipitation time or a decrease in productivity (normalized shell molar addition rate was maintained the same).

Example 4

Two silver bromide emulsions were prepared in which the variation made was the addition of NaCl between formation of the core and shell portions of the silver halide grain.

Emulsion 4.1 (Comparison)

To a reactor containing 4.5 kg of distilled water, 1.7 g of $((HOCH_2CH_2SCH_2)_2$ and 350 g of bone gelatin, were added 8.34 g of sodium bromide such that the mixture was maintained at a pBr of about 1.75 at approximately 75° C. Aqueous solutions of about 3.1 M silver nitrate and about 3.5 M sodium bromide were then added by conventional controlled double-jet addition at a constant silver nitrate flow rate of about 15 ml/min for about 3.0 minutes while maintaining pBr constant at about 1.75 and then the silver salt addition rate was accelerated over the next 19 minutes to 125 ml/min. The pBr was ramped with the accelerating silver salt flow to a value of 3.2. This is considered to be the core of the silver halide grain containing 18.1% of the total silver moles.

The grain shell was then grown under a balanced double jet addition such that the silver nitrate addition rate was maintained over a 27.0 minute period at 195 ml/min at constant pBr of 3.2, for a total silver salt addition time of 49.0 minutes, with a normalized shell molar addition rate of $1.13\times10^{-3}$ $min^{-2}$. At the completion of the silver salt addition, the temperature was adjusted to 40° C. The silver bromide emulsion thus prepared had an ESD of 0.82 $\mu$m.

Emulsion 4.2 (Invention)

An emulsion was grown with an identical core such as described in Emulsion 4.1. To this solution was added 2.0 g of NaCl. The grain shell was then grown under a balanced double jet addition such that the silver nitrate addition rate was maintained over a 25.0 minute period at 210 ml/min at constant pBr of 3.2, for a total silver salt addition time of 47.0 minutes, with a normalized shell molar addition rate of $1.30\times10^{-3}$ $min^{-2}$. At the completion of the silver salt addition, the temperature was adjusted to 40° C. The silver bromide emulsion thus prepared had an ESD of 0.83 $\mu$m.

Emulsions 4.1 and 4.2 were washed by the ultrafiltration method described in *Research Disclosure*, Vol. 131, March 1975, Item 13122, and analyzed for grain size distribution using disc centrifuge techniques. The average grain equivalent spherical diameter, ESD, and ESD width index obtained are indicated in Table 4:

TABLE 4

| Example | ESD | ESD Width Index | $R_i$ Rate [mol/min/$m^2$] |
|---|---|---|---|
| Emulsion 4.1 - Comparison | 0.82 | 1.059 | 360 |
| Emulsion 4.2 - Invention | 0.83 | 1.058 | 390 |

Figure 5:
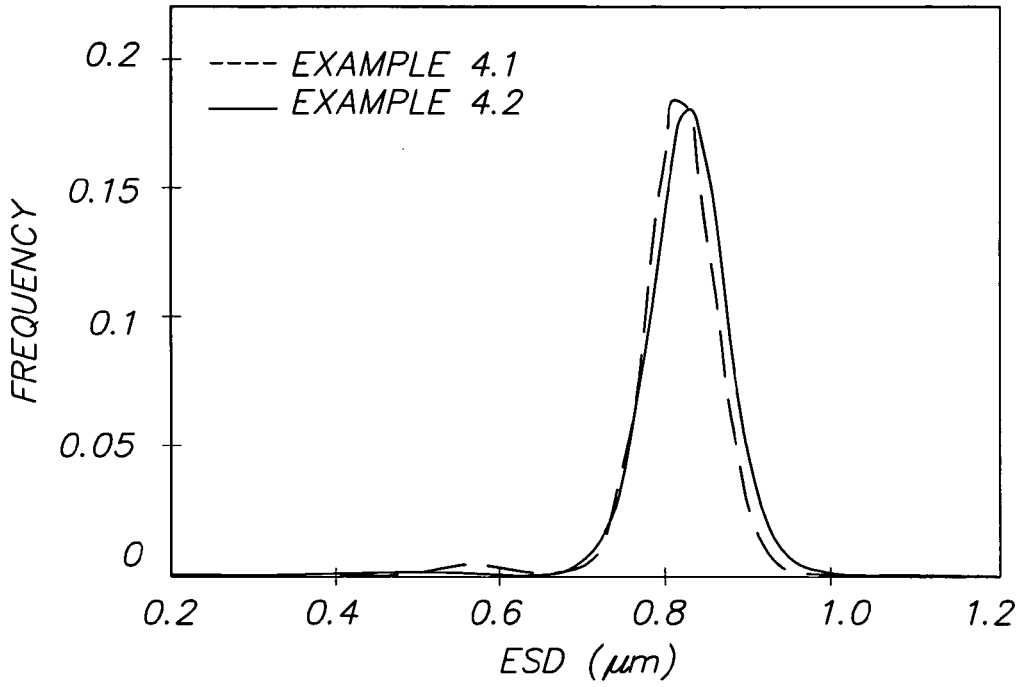
FIG. 5 is a graph of grain size populations of the two emulsions of Example 4.

FIG. 5 represents the grain size populations of the two emulsions of Example 4 measured using disc centrifuge apparatus. Emulsion 4.1 contained a small, but identifiable secondary grain population. The shell of the inventive Emulsion 4.2 was precipitated at a greater surface area normalized instantaneous molar addition rate $R_i$ (relative to that of Emulsion 4.1), without the formation of a secondary grain population. Hence, the inventive emulsion had a shorter precipitation time, larger normalized shell molar addition rate and increased emulsion productivity.

Example 5

Two high bromide silver halide emulsions were prepared in which the main variation made was the halide salt solution composition addition for the shell portions of the silver halide grain.

Emulsion 5.1 (Comparison)

To a reactor containing 4.5 kg of distilled water, 1.5 g of $(HOCH_2CH_2SCH_2)_2$ and 360 g of bone gelatin, were added 8.4 g of sodium bromide such that the mixture was maintained at a pBr of about 1.77 at approximately 75° C. Aqueous solutions of about 3.1 M silver nitrate and about 3.3 M sodium bromide were then added by conventional controlled double-jet addition at a constant silver nitrate flow rate of about 14 ml/min for about 3.0 minutes while maintaining pBr constant at about 1.77 and then the silver salt addition rate was accelerated over the next 14.5 minutes to 125 ml/min. The pBr was ramped with the accelerating silver salt flow to a value of 3.1. This is considered to be the core of the silver halide grain containing 12.5% of the total silver moles.

The grain shell was then grown under a balanced double jet addition such that the silver nitrate addition rate was maintained over a 28.5 minute period at 195 ml/min at constant pBr of 3.1, for a total silver salt addition time of 46.0 minutes, with a normalized shell molar addition rate of $1.08\times10^{-3}$ $min^{-2}$. At the completion of the silver salt addition, the temperature was adjusted to 40° C. The silver bromide emulsion thus prepared had an ESD of 0.87 $\mu$m.

Emulsion 5.2 (Invention)

An emulsion was grown with a core similarly as described in Emulsion 5.1, except the reactor contained 1.7 g of $(HOCH_2CH_2SCH_2)_2$. The grain shell was then grown with aqueous solutions of 3.1 M silver nitrate and a mixed salt solution with concentration 2.8M NaBr, 0.5M NaCl, and 0.0165M KI. The grain shell was grown under a balanced double jet addition such that the silver nitrate addition rate was maintained over a 27.0 minute period at 210 ml/min at constant pBr of 3.1, for a total silver salt addition time of 44.5 minutes, with a normalized shell molar addition rate of $1.20\times10^{-3}$ $min^{-2}$. At the completion of the silver salt addition, the temperature was adjusted to 40° C. The silver bromide emulsion thus prepared had an ESD of 0.85 $\mu$m.

Emulsions 5.1 and 5.2 were washed by the ultrafiltration method described in *Research Disclosure*, Vol. 131, March 1975, Item 13122, and analyzed for grain size distribution using disc centrifuge techniques. The average grain equivalent spherical diameter, ESD, and ESD width index obtained are indicated in Table 5:

TABLE 5

| Example | ESD | ESD Width Index | $R_i$ Rate [mol/min/m$^2$] |
|---|---|---|---|
| Emulsion 5.1 - Comparison | 0.87 | 1.061 | 490 |
| Emulsion 5.2 - Invention | 0.85 | 1.055 | 510 |

Figure 6:
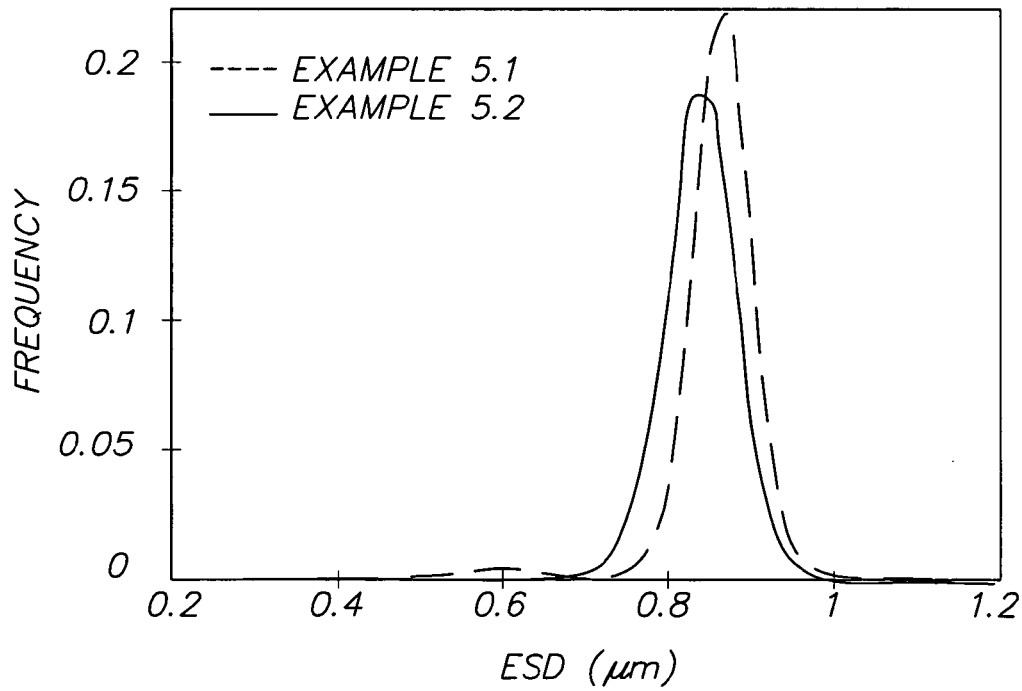
FIG. 6 is a graph of grain size populations of the two emulsions of Example 5.

FIG. 6 represents the grain size populations of the two emulsions of Example 5 measured using disc centrifuge apparatus. Emulsion 5.1 contained a small, but identifiable secondary grain population. The shell of the inventive Emulsion 5.2 was precipitated at a greater surface area normalized instantaneous molar addition rate $R_i$ (relative to that of Emulsion 5.1), without the formation of a secondary grain population. Hence, the inventive emulsion had a shorter precipitation time, larger normalized shell molar addition rate and increased emulsion productivity.

The invention has been described in detail with particular reference to preferred embodiments thereof, but it will be understood that variations and modifications can be effected within the spirit and scope of the invention.

What is claimed is:

1. A process for the preparation of a radiation-sensitive silver halide emulsion comprised of high bromide cubical silver halide grains, the process comprising:

(a) providing in a stirred reaction vessel a dispersing medium and high bromide silver halide grain cores, the grain cores comprising at least 5 mole % of the final emulsion silver and the contents of the vessel being maintained at a temperature of at least about 65° C., and (b) precipitating a high bromide silver halide shell which comprises at least 5 mole % of the final emulsion silver onto the grain cores by introducing at least a silver salt solution into the dispersing medium at a rate such that (i) the normalized shell molar addition rate, $R_s$, is above $1.0\times10^{-3}$ $min^{-2}$, $R_s$ satisfying the formula:

$$R_s = \frac{M_s}{M_t t_s^2}$$

where $M_s$ is the number of moles of silver halides added to the reaction vessel during the formation of the shell, $t_s$ is the run time, in minutes, of the silver salt solution for the formation of the shell, and $M_t$ is total moles of silver halide in the reaction vessel at the end of the precipitation of the shell, and (ii) when the contents of the reaction vessel are maintained at a temperature of from 65° C. to 70° C., the surface area normalized instantaneous molar addition rate, $R_i$, is above (24T-1380) mol/min/m$^2$ during at least a portion of the shell growth, where T represents the temperature of the contents of the vessel in ° C., and when the contents of the vessel are maintained at a temperature above 70° C., $R_i$ is above 300 mol/min/m$^2$, $R_i$ satisfying the formula:

$$R_i = \frac{Q_f C_f}{nS_c}$$

where $Q_f$ is the volumetric rate of addition, in liters/min, of silver salt solution to the reaction vessel, $C_f$ is the concentration, in moles/liter, of the silver salt solution, $S_c$ is the average surface area of an individual grain core already formed in the vessel, and n is the total number of grain cores in the vessel;

wherein a minor percentage of chloride ions, relative to bromide, is introduced into the reaction vessel prior to or concurrent with precipitation of the high bromide shell, and wherein the concentration of silver halide grains in the reaction vessel at the end of the precipitation of the shell is at least 0.5 mole/L.

2. The process according to claim 1, wherein in step (b) a halide salt solution is simultaneously introducing into the dispersing medium with the silver salt solution.

3. The process according to claim 1, wherein the concentration of silver halide grains in the reaction vessel at the end of the precipitation of the shell is at least 0.8 mole/L.

4. The process according to claim 1, wherein the concentration of silver halide grains in the reaction vessel at the end of the precipitation of the shell is at least 1.0 mole/L.

5. The process according to claim 1, wherein the grain cores provided in step (a) comprise at least 10 mole % of the final emulsion silver.

6. The process according to claim 5, wherein the grain cores provided in step (a) comprise from 10 to 50 mole % of the final emulsion silver.

7. The process according to claim 5, wherein the grain cores provided in step (a) comprise from 10 to 30 mole % of the final emulsion silver.

8. The process according to claim 1, wherein the silver halide shell precipitated during step (b) comprises at least 20 mole % of the final emulsion silver.

9. The process according to claim 1, wherein the silver halide shell precipitated during step (b) comprises greater than 50 mole % of the final emulsion silver.

10. The process according to claim 1, wherein the silver halide shell precipitated during step (b) comprises at least 60 mole % of the final emulsion silver.

11. The process according to claim 1, wherein the silver halide shell precipitated during step (b) comprises at least 70 mole % of the final emulsion silver.

12. The process according to claim 1, wherein the high bromide cubical silver halide grains contain at least 70 mole percent bromide, based on silver.

13. The process according to claim 1, wherein the high bromide cubical silver halide grains contain at least 90 mole percent bromide, based on silver.

14. The process according to claim 1, wherein the high bromide cubical silver halide gains comprise from 0.2 to 20 mole percent chloride, based on silver.

15. The process according to claim 1, wherein high bromide cubic silver halide grains are formed.

16. The process according to claim 1, wherein the high bromide cubical grains have an average equivalent spherical diameter of at least 0.5 micrometers and a grain size coefficient of variation of less than 20%.

17. The process according to claim 16, wherein the high bromide cubical grains have an average equivalent spherical diameter of at least 0.7 micrometers.

18. The process according to claim 1, wherein $R_i$ is above 300 mol/min/$m^2$ during at least a portion of the shell growth when the contents of the reaction vessel are maintained at a temperature of at least 65° C.

19. The process according to claim 1, wherein $R_i$ is above 350 mol/min/$m^2$ during at least a portion of the shell growth when the contents of the reaction vessel are maintained at a temperature of at least 65° C.

* * * * *